United States Patent [19]

Robinson et al.

[11] 4,053,285

[45] Oct. 11, 1977

[54] PROCESS FOR REDUCING THE SULFIDE SULFUR CONTENT OF CHAR WITH CARBON DIOXIDE AND $H_2O$

[75] Inventors: Leon Robinson, Houston, Tex.; Allan Sass, Los Angeles, Calif.

[73] Assignee: Occidental Research Corporation, La Verne, Calif.

[21] Appl. No.: 649,355

[22] Filed: Jan. 15, 1976

Related U.S. Application Data

[63] Continuation-in-part of Ser. No. 461,992, April 18, 1974, abandoned.

[51] Int. Cl.[2] ..... C10L 9/10; C10B 57/00

[52] U.S. Cl. ..... 44/1 F; 44/1 R; 201/17

[58] Field of Search ..... 44/1 R, 1 F; 201/17

[56] References Cited

U.S. PATENT DOCUMENTS

| | | | |
|---|---|---|---|
| 2,872,384 | 2/1959 | Nelson et al. | 201/17 X |
| 2,983,673 | 5/1961 | Grove | 201/17 X |
| 3,251,751 | 5/1966 | Lindahl | 201/17 X |
| 3,402,998 | 9/1968 | Squires | 23/181 |
| 3,917,795 | 11/1975 | Pelczarski et al. | 423/168 |

*Primary Examiner*—Carl F. Dees

*Attorney, Agent, or Firm*—Fulwider, Patton, Rieber, Lee & Utecht

[57] ABSTRACT

This invention covers a process for reducing the sulfide sulfur content of char by treatment with a gaseous mixture of carbon dioxide and $H_2O$.

10 Claims, 1 Drawing Figure

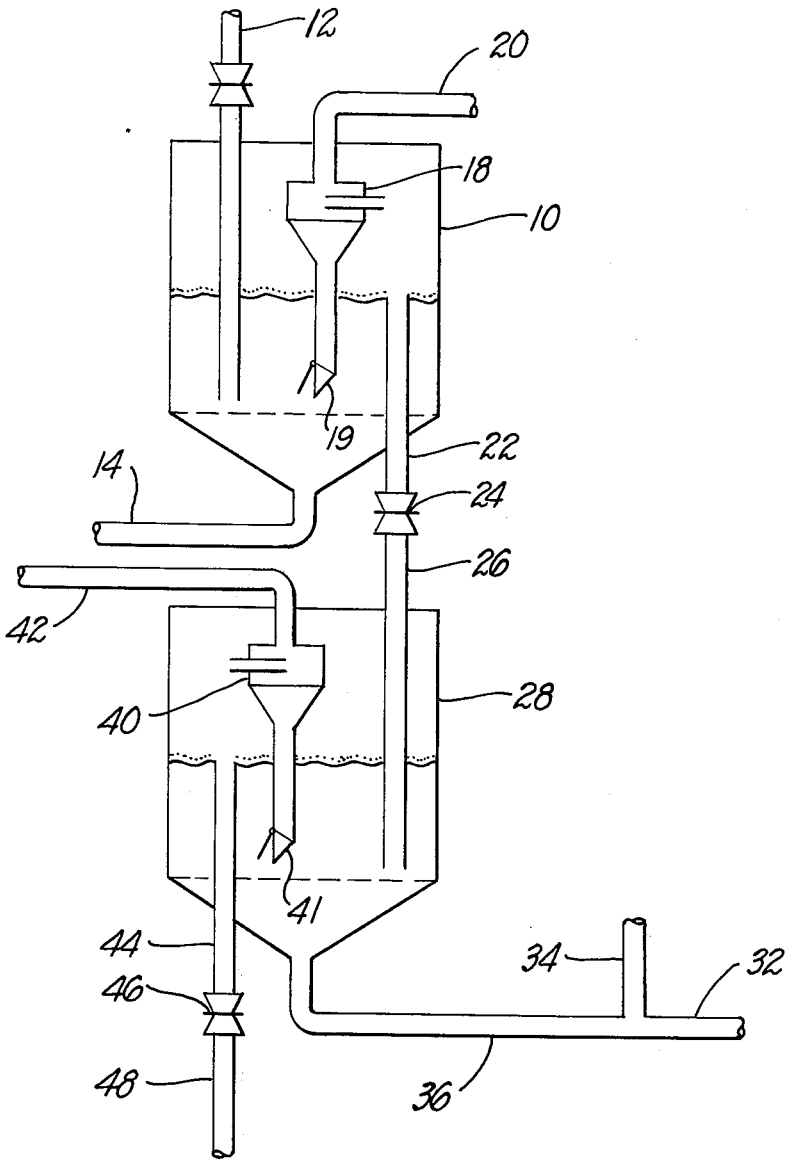
12
20
18
10
19
22
14
24
26
42
28
40
41
44
34
32
46
48
36

PROCESS FOR REDUCING THE SULFIDE SULFUR CONTENT OF CHAR WITH CARBON DIOXIDE AND $H_2O$

BACKGROUND OF THE INVENTION

Char is used as a fuel and is manufactured by partially pyrolyzing coal or other carbonaceous materials. Char contains sulfur which is objectionable because upon combustion, the sulfur forms sulfur dioxide, an air pollutant. Governmental air purity standards limit the use of fuels to fuels containing relatively low concentrations of sulfur. The presence in char of sulfur concentrations which exceed such limits has restricted the use of char as a fuel. The need for a relatively sulfur-free char has therefore become very important, especially in view of dwindling supplies of oil and natural gas and abundant supplies of coal.

Methods have been devised to desulfurize char but they are commercially unacceptable for removing enough of the sulfur to comply with air purity standards. One such method is to treat the char with hydrogen gas at elevated temperatures to cause a reaction between the hydrogen and the sulfur to form hydrogen sulfide gas. This method reduces the level of sulfur present as organic sulfur and pyritic sulfur, but it increases the levels of the remaining sulfide sulfur due to reactions which convert some of the pyritic and organic sulfur to sulfide sulfur. Thus, the benefit to be gained by minimizing the pyritic and organic sulfur contents is offset by an increase in the sulfide sulfur content.

Organic sulfur refers to the sulfur which forms a part of organic molecules contained in the char. Pyritic sulfur refers to the sulfur that forms a part of iron pyrite, $FeS_2$, found in char. Sulfide sulfur refers to the sulfur that forms a part of inorganic sulfur compounds found in char, such as, for example, FeS and CaS. Pyritic sulfur is an inorganic sulfur but is not comprehended by the term "sulfide sulfur" as used herein.

The sulfide sulfur content of char is difficult to reduce by treatment with hydrogen because the hydrogen used for such purpose usually contains trace amounts of hydrogen sulfide which inhibit the reaction between the sulfur in the char and the hydrogen gas. This inhibition to reaction with hydrogen can be reduced by increasing the temperature of reaction but this causes a corresponding increase in the amount of char that is gasified and lost by conversion to carbon dioxide.

SUMMARY OF THE INVENTION

It has been discovered that the increased sulfide sulfur content of char associated with hydrogen treatment at elevated temperatures may be significantly reduced by treating the char with a gaseous mixture of carbon dioxide and $H_2O$ at temperatures that will not cause any appreciable gasification of the char. Said carbon dioxide-$H_2O$ treatment is also very effective in reducing the sulfide sulfur content of char whether or not the char has been pretreated with hydrogen.

EMBODIMENT OF THE INVENTION

An embodiment of the invention is schematically depicted in the accompanying drawing.

A reactor 10 is provided and has a char feed line 12 and a hydrogen inlet line 14 in communication therewith. Cyclone 18 is disposed within said reactor 10 and communicates with the interior thereof through outlet 19 to a hydrogen recovery system (not shown) through outlet 20. Standpipe 22 is provided in the bottom portion of reactor 10 for communication with said reactor 10 and with steam-carbon dioxide reactor 28 through char feed line 26. Slide valve 24 is provided in standpipe 22 and in char feed line 26. Reactor 28 is in communication with gas line 36 in the bottom portion thereof which is in communication with steam line 32 and carbon dioxide line 34. Cyclong 40 is provided within the interior of reactor 28 and is in communication therewith through outlet 41 and with a hydrogen recovery system (not shown) through outlet 42. Standpipe 44 is provided in reactor 28 for communication therewith and with char outlet line 48. Slide valve 46 is provided in standpipe 44 and in char outlet line 48.

In operation, char is crushed to a particle size suitable for gravity flow through char feed line 12 and is fed through char line 12 to form a bed of char particles in reactor 10. Hydrogen gas enters reactor 10 through inlet pipe 14, and depending upon the pressure of said hydrogen gas and the particle size of the char, will cause the reactor 10 to be operated as either a fluidized bed, an entrained bed, or expanded bed system. The char is held in reactor 10 for a prescribed residence time sufficient to convert the organic and pyritic sulfur to sulfide sulfur. Thereafter slide valve 24 is opened to allow the reacted char particles to flow through standpipe 22 and line 26 and into the steam-carbon dioxide reactor 28. The char is caused to flow through standpipe 22 by introducing unreacted char particles through line 12. The unreacted char from line 12 accumulates at the bottom portion of reactor 10 to cause the level of the reacted char bed to rise and flow into standpipe 22.

Any excess hydrogen gas and the gases evolved from the hydrogen reaction with the char exit out of reactor 10 through cyclone 18 which prevents the char particles from leaving the reactor 10 with the exit gases.

Upon opening slide valve 24, the reacted char particles from reactor 10 pass through standpipe 22 and char feed line 26 into reactor 28 to form a bed of char particles. A gaseous mixture of steam and carbon dioxide enters reactor 28 from line 36. The carbon dioxide and steam are introduced and mixed in line 36 from steam line 32 and carbon dioxide line 34. The char is retained in reactor 28 for a prescribed period and thereafter slide valve 24 is opened to permit more char to enter reactor 28 from reactor 20 which will cause the level of the char in reactor 28 to rise and flow into standpipe 44. Slide valve 46 is opened to permit the char particles in standpipe 44 to flow by gravity through outlet line 48 for recovery. The excess carbon dioxide and steam mixture and the gases evolved from the reaction of char with said mixture exit out of reactor 28 through cyclone 40 which prevents the char particles from leaving the reactor 28 with the exit gases.

In the operation of reactor 10, hydrogen gas enters through inlet pipe 14 at pressures up to about 500 psia and at flow rates of about 5 to about 100 cubic feet of hydrogen per pound of char. The char is held in reactor 10 for a period about 5 minutes to about 2 hours and at a temperature range of about 1100° F. to about 1800° F. In the preferred embodiment, the hydrogen treatment is carried on at about 1300° to about 1600° F., at pressures from about 25 to about 150 psia, and at a volume of about 5 to about 100 cubic feet of hydrogen per pound of char.

In the operation of reactor 28, the mixture of carbon dioxide to steam is maintained at a temperature of from about 500° F to about 1600° F and at a ratio of about 1:5 to about 5:1, respectively, but in the preferred embodiment, the ratio is about 1:1. The flow rate of the carbon dioxide-steam mixture can vary from about 5 to about 100 cubic feet of said mixture per pound of char, but in the preferred embodiment the flow rate is about 25 cubic feet of said mixture per pound of char. Said mixture has a pressure ranging from about atmospheric to about 500 psia and a temperature ranging from about 700° F. to about 1200° F. In the preferred embodiment the pressure and temperature of said mixture are about 50 psia and about 1000° F., respectively. The residence time of the char in reactor 28 for said carbon dioxide and steam treatment can range from about 5 minutes to about 2 hours but is preferably about 30 minutes.

The embodiment described herein utilizes a hydrogen pretreatment step which is described in connection with reactor 10. It is to be understood, however, that said pretreatment with hydrogen forms no part of the instant invention and is not to be construed as a limitation thereon.

EXAMPLE I

West Kentucky bituminous coal was carbonized at 1000° F. for 2 hours in a nitrogen atmosphere to produce a char. This char was ground to −200 mesh and a 10 gram portion thereof was treated with 0.09 standard cubic feet per minute (SCFM) of hydrogen at 1600° F. and at atmospheric pressure. An analysis of the coal prior to conversion into char and an analysis of the char after the treatment with hydrogen was made in terms of sulfur content, moisture content, and ash content and the results noted in Table 1 hereinbelow.

A 10 gram portion of the hydrogen treated char was placed in a 3 foot long stainless steel tube having a ¾ inch interval diameter and was plugged at the top with quartz wool to prevent the char from blowing out. The tube was heated until reaching 1000° F. and 0.02 SCFM of nitrogen was purged through the tube from the bottom end to prevent any reaction with atmospheric oxygen. The tube was maintained at 1000° F., and a gaseous mixture comprised of 0.10 SCFM of carbon dioxide and 0.10 SCFM of steam (2.28 ml/minutes of water) were passed into the tube. The carbon dioxide was metered into the system through a calibrated rotameter, and the water was pumped into the system through a calibrated rotameter with a constant displacement pump from a calibrated water reservoir. The carbon dioxide and water were heated to 1000° F. in a preheater before being introduced into the stainless steel tube containing the char. The carbon dioxide-steam pressure was maintained at 65 pounds per square inch for 30 minutes. Thereafter the heat and the flow of carbon dioxide and steam were shut off, and about 0.02 SCFM of nitrogen was pumped through the system to stop the reaction. The char was removed and analyzed. The analysis is set forth in Table I hereinbelow.

Table I

| Material | Total Sulfur Wt. % | Sulfide Sulfur Wt. % | Pyritic Sulfur Wt. % | Organic Sulfur Wt. % | Water Content Wt. % | Ash Content Wt. % |
|---|---|---|---|---|---|---|
| 1. Coal prior to conversion to char. | 3.73 | 0.17 | 2.04 | 1.52 | 4.36 | 14.95 |
| 2. Char after hydrogen treatment. | 2.11 | 1.27 | 0.05 | 0.79 | 0.48 | 22.47 |
| 3. Char after hydrogen treatment and $CO_2$-steam treatment. | 1.04 | 0.21 | 0.04 | 0.79 | 0.99 | 22.17 |

EXAMPLE II

To demonstrate the effect of carbon dioxide in the instant invention, two 10-gram samples of char were prepared as described in Example I. An analysis of the sulfur content of each sample was made and the results are set forth in Table 2 hereinbelow. The first sample was treated with a mixture of 0.05 SCFM carbon dioxide and 0.05 SCFM of steam at a ratio of one part of carbon dioxide to one part of steam, and under a pressure of 50 psi for 30 minutes and at a temperature of 1000° F. The second specimen was treated in the same manner and under the same conditions as the first sample, but 0.05 standard cubic feet per minute of nitrogen were substituted for the carbon dioxide used for the first sample. Thereafter, each sample was analyzed for its sulfur ash contents and the results noted in Table II. It is noted that the specimen treated with the carbon dioxide-steam mixture has a lower over-all sulfur content and lower sulfide and pyritic sulfur content as opposed to the sample treated with the mixture of nitrogen and steam.

Table II

| Gas Mixture Used for treatment. | Initial Sulfur Content Wt. % | Final Sulfur Content Wt. % | Final Sulfide Sulfur Content Wt. % | Final Pyritic Sulfur Content Wt. % | Final Organic Sulfur Content Wt. % | Final Ash Content Wt. % |
|---|---|---|---|---|---|---|
| 0.05 SCFM $CO_2$ and 0.05 SCFM Steam. | 2.11 | 1.18 | 0.35 | 0.05 | 0.78 | 24.23 |
| 0.05 SCFM $N_2$ and 0.05 SCFM Steam. | 2.11 | 1.79 | 1.05 | 0.11 | 0.63 | 22.70 |

EXAMPLE III

West Kentucky bituminous coal was pyrolyzed at 1200° F for about 2 to 4 seconds in a nitrogen atmosphere to produce a char which was ground to −60 mesh. An analysis of the char was made in terms of carbon, hydrogen, nitrogen, sulfur, ash and volatile matter content as well as various sulfur forms and is reported on a dry basis in Table III.

A 10 gram portion of the char was placed in a three foot long stainless steel tube having a 1¼ inch internal diameter and was plugged at each end of the char interval with KAOWOOL. The tube was heated to 1200° F and purged with 0.02 SCFM of $N_2$ to prevent oxidation by atmospheric oxygen. The tube was maintained at 1200° F, and gaseous mixtures described in Table III hereinbelow were passed into the tube for the indicated length of time at 15 psia. Thereafter the heat and flow of the gas mixture were shut off, and about 0.02 SCFM nitrogen was pumped through the system to purge the reactant gases and stop the reaction. The char was removed and analyzed. The analyses are set forth in Table III.

TABLE III

| | Total Sulfur wt. % | Sulfide Sulfur wt. % | Pyritic Sulfur wt. % | Sulfate Sulfur wt. % | Organic Sulfur wt. % |
|---|---|---|---|---|---|
| Char composition before treatment | 1.68 | 0.20 | 0.22 | 0.06 | 1.20 |
| Gas used for treatment | | | | | |
| $N_2$ and steam for 60 min. | 1.19 | 0.04 | 0.05 | <0.01 | 1.09 |
| $N_2$ and $CO_2$ for 60 min. | 1.53 | 0.12 | 0.06 | <0.01 | 1.34 |
| $N_2$ and $CO_2$ for 60 min. followed by $N_2$ and steam for 60 min. | 1.05 | 0.02 | 0.05 | <0.01 | 0.97 |
| $N_2$ and steam for 60 min. followed by $N_2$ and $CO_2$ for 60 min. | 1.09 | 0.04 | 0.04 | <0.01 | 1.00 |
| $CO_2$ and steam for 60 min. | 1.15 | <0.01 | NES* | NES | 1.14 |
| $N_2$ for 60 min. | NES* | 0.42 | 0.05 | 0.01 | NES |

*Not Enough Sample for Analysis

EXAMPLE IV

West Kentucky bituminous coal was pyrolyzed at 1200° F for about 2 to 4 seconds in a nitrogen atmosphere to produce a char. This char was ground to −60 mesh and treated in an entrained bed reactor with sufficient oxygen to provide 10% oxidation at 1600° F for a period of approximately ½ second. An analysis of the −60 mesh char was made in terms of carbon, hydrogen, nitrogen, sulfur, ash and volatile matter content as well as various sulfur forms and is reported on a dry basis in Table IV.

A 10 gram portion of the char was placed in a three foot long stainless steel tube having a 1¼ inch internal diameter and was plugged at each end of the char interval with KAOWOOL. The tube was heated to 1200° F and purged with 0.02 SCFM of $N_2$ to prevent oxidation by atmospheric oxygen. The tube was maintained at 1200° F, and gaseous mixtures described in Table IV hereinbelow were passed into the tube for the indicated length of time at 15 psia. Thereafter the heat and flow of the gas mixture were shut off, and about 0.02 SCFM nitrogen was pumped through the system to purge the reactant gases and stop the reaction. The char was removed and analyzed. The analyses are set forth in Table IV.

TABLE IV

| | Total Sulfur wt. % | Sulfide Sulfur wt. % | Pyritic Sulfur wt. % | Sulfate Sulfur wt. % | Organic Sulfur wt. % |
|---|---|---|---|---|---|
| Char composition before treatment | 1.95 | 0.57 | 0.07 | 0.11 | 1.20 |
| Gas used for treatment | | | | | |
| $N_2$ for 60 min. | 1.59 | NES | NES | NES | NES |
| $N_2$ and steam for 60 min. | 1.37 | NES | NES | NES | NES |
| $N_2$ and $CO_2$ for 60 min. | 1.79 | NES | NES | NES | NES |
| $N_2$ and $CO_2$ for 60 min. followed by $N_2$ and steam for 60 min. | 1.32 | 0.02 | 0.09 | 0.06 | 1.15 |
| $N_2$ and steam for 60 min. followed by $N_2$ and $CO_2$ for 60 min. | 1.50 | 0.04 | 0.08 | 0.09 | 1.24 |
| $CO_2$ and steam for 60 min. | 1.57 | 0.01 | 0.12 | 0.10 | 1.34 |

EXAMPLE V

The char prepared in Example IV was placed in a pipe furnace at 1600° F for a period of 1 hour with nitrogen flow. An analysis of the −60 mesh char was made in terms of carbon hydrogen, nitrogen, sulfur, ash and volatile matter content as well as various sulfur forms as is reported on a dry basis in Table V.

A 10 gram portion of the char was placed in a 3 foot long stainless steel tube having a 1¼ inch internal diameter and was plugged at each end of the char interval with KAOWOOL. The tube was heated to 1600° F and purged with 0.02 SCFM of $N_2$ to prevent oxidation by atmospheric oxygen. The tube was maintained at 1600° F, and gaseous mixtures described in Table V hereinbelow were passed into the tube for the indicated length of time at 15 psia. Thereafter the heat and flow of the gas mixture were shut off, and about 0.02 SCFM nitrogen was pumped through the system to purge the reactant gases and stop the reaction. The char was removed and analyzed. The analyses are set forth in Table V.

TABLE V

| | Total Sulfur wt. % | Sulfide Sulfur wt. % | Pyritic Sulfur wt. % | Sulfate Sulfur wt. % | Organic Suflur wt. % |
|---|---|---|---|---|---|
| Char composition before treatment | 2.13 | 0.82 | 0.07 | <0.01 | 1.27 |
| Gas used for treatment | | | | | |
| $N_2$ for 15 min. | 1.92 | 1.04 | 0.08 | <0.01 | 0.79 |
| $N_2$ and steam for 15 min. | 1.66 | 0.57 | 0.11 | <0.01 | 0.97 |
| $N_2$ and $CO_2$ for 15 min. | 1.87 | 1.05 | 0.09 | <0.01 | 0.72 |
| $CO_2$ and steam for 15 min. | 1.47 | 0.32 | 0.12 | <0.01 | 1.02 |

It will be observed from Examples III and IV that when the char is treated for relatively long periods of time, i.e., 60 minutes, the sulfide sulfur content was reduced to a low value, except for the treatment with nitrogen. The advantage of using the carbon dioxide-steam mixture of the instant invention as opposed to the other gases is realized at the shorter treatment times of 15 minutes in Example V and 30 minutes in Examples I and II. During such shorter periods of treatment, it will be observed that carbon dioxide and steam mixtures yield significantly improved results in reducing the sulfide sulfur content of char as compared to the other gases tested.

In the examples hereinabove, an inert gas such as nitrogen is used to purge oxygen from the char prior to said carbon dioxide-water treatment to minimize the possibility of any reactions therewith. The elimination of oxygen from the char is not necessary to practice the instant invention, but is done only to prevent any confusion over the comparative results set forth in the examples which might arise due to the reactions with oxygen.

The embodiments and examples set forth herein have been described in terms of the reduction of sulfide sulfur char manufactured from coal. It is to be understood, however, that the instant invention is not limited thereto, but may be used to reduce the sulfide sulfur content of chars manufactured from other carbonaceous materials. It is to be further understood that, while the operating conditions of time, pressure, temperature and flow rate, and ratio of carbon dioxide to water set forth herein appear to be the practical ranges for use in the instant invention, each one of these operating conditions is subject to a wide degree of variability, depending upon the remaining operating conditions, and it is to be understood that this invention is intended to cover all changes and modifications in such operating conditions which fall within the spirit and scope of the invention.

We claim:

1. In a method for reducing the sulfide sulfur content of char, the step comprising treating said char with a gaseous mixture of carbon dioxide and $H_2O$ at a temperature of from about 500° F to about 1600° F.

2. In a method as set forth in claim 1, wherein said gaseous mixture has a ratio of carbon dioxide to $H_2O$ of about 1:5 to about 5:1.

3. In a method as set forth in claim 1, wherein said gaseous mixture has a ratio of carbon dioxide to $H_2O$ of about 1:5 to about 5:1, a flow rate of about 5 to about 100 standard cubic feet per pound of char and a pressure from about atmospheric to about 500 psia, said char being treated with said mixture for about 5 minutes to about 2 hours.

4. In a method as set forth in claim 1, wherein said gaseous mixture has a ratio of carbon dioxide to $H_2O$ of about 1:1, a flow rate of about 25 standard cubic feet per pound of char, a temperature of about 1000° F, a pressure of about 50 psia, said char being treated with said mixture for about 30 minutes.

5. In a method for reducing the sulfide sulfur content of char, wherein said char has been partially desulfurized by treatment with hydrogen gas, the step comprising treating said char with a gaseous mixture of carbon dioxide and $H_2O$ at a temperature from about 500° F to about 1600° F.

6. In a method as set forth in claim 5, wherein said gaseous mixture has a ratio of carbon dioxide to $H_2O$ of about 1:5 to about 5:1.

7. In a method as set forth in claim 5, wherein said gaseous mixture has a ratio of carbon dioxide to $H_2O$ of about 1:5 to about 5:1, a flow rate of about 5 to about 100 standard cubic feet per pound of char, a temperature from about 700° F to about 1200° F, and a pressure from aboout atmospheric to about 500 psia, said char being treated with said mixture for about 5 minutes to about 2 hours.

8. In a method as set forth in claim 5, wherein said gaseous mixture has a ratio of carbon dioxide to $H_2O$ of about 1:1, a flow rate of about 25 standard cubic feet per pound of char, a temperature of about 1000° F, a pressure of about 50 psia, said char being treated with said mixture for about 30 minutes.

9. A process for reducing the sulfide sulfur content of char comprising treating said char simultaneously with carbon dioxide and $H_2O$ at a temperature below the temperature at which appreciable $H_2O$ — carbon reaction occurs and carbon dioxide — carbon reaction occurs.

10. A process for reducing the sulfur content of char comprising:

a. heating said char at a temperature and for a period of time sufficient to convert a portion of the sulfur content of said char to sulfide sulfur; and b. treating said char simultaneously with carbon dioxide and steam at a temperature below the temperature at which appreciable $H_2O$ — carbon reaction occurs and carbon dioxide — carbon reaction occurs.

* * * * *

UNITED STATES PATENT OFFICE

CERTIFICATE OF CORRECTION

Patent No. 4,053,285 Dated October 11, 1977

Inventor(s) Leon Robinson and Allan Sass

It is certified that error appears in the above-identified patent and that said Letters Patent are hereby corrected as shown below:

Column 2, line 8, delete "cyclong" insert -- cyclone --.

Column 3, line 35, delete "interval" and insert -- internal --.

Column 4, line 31, after sulfide insert -- sulfur --.

Column 8. line 9. delete "aboout" and insert

Signed and Sealed this

Fourth Day of April 1978

[SEAL]

Attest:

RUTH C. MASON
Attesting Officer

LUTRELLE F. PARKER
Acting Commissioner of Patents and Trademarks